US006552602B2

(12) United States Patent
Pernici et al.

(10) Patent No.: US 6,552,602 B2
(45) Date of Patent: Apr. 22, 2003

(54) CIRCUIT GENERATING A STABLE REFERENCE VOLTAGE WITH RESPECT TO TEMPERATURE, PARTICULARLY FOR CMOS PROCESSES

(75) Inventors: Sergio Pernici, Bergamo (IT); Fabio Stevenazzi, Locate Varesino (IT); Germano Nicollini, Piacenza (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 10/032,231

(22) Filed: Dec. 21, 2001

(65) Prior Publication Data

US 2002/0140498 A1 Oct. 3, 2002

(30) Foreign Application Priority Data

Dec. 22, 2000 (IT) ..... MI2000A2806

(51) Int. Cl.[7] ..... G05F 1/10
(52) U.S. Cl. ..... 327/540
(58) Field of Search ..... 323/311, 312, 323/313, 314, 315; 327/512, 513, 530, 534, 535, 537, 538, 539, 540, 541, 542, 543, 545, 546

(56) References Cited

U.S. PATENT DOCUMENTS 6,118,327 A * 9/2000 Watarai ..... 327/513

* cited by examiner

*Primary Examiner*—Jeffrey Zweizig
(74) *Attorney, Agent, or Firm*—Lisa K. Jorgenson; Robert Iannucci; Seed IP Law Group PLLC

(57) ABSTRACT

It is described a circuit generating a stable reference voltage with respect to temperature, which circuit is connected between first and second voltage references and comprises at least one current generating circuit adapted to inject a reference current into a resistive element connected between a base terminal of a bipolar transistor and an additional voltage reference. The bipolar transistor is connected between the first and second voltage references and to an output terminal of the generator circuit whereat the stable reference voltage with respect to temperature is. The generator circuit further comprises at least another resistive element, feedback connected between the output terminal of the generator circuit and the base terminal of the bipolar transistor to enable injecting additional current, having reverse dependence on temperature from the reference current, into the resistive element.

17 Claims, 4 Drawing Sheets

CIRCUIT GENERATING A STABLE REFERENCE VOLTAGE WITH RESPECT TO TEMPERATURE, PARTICULARLY FOR CMOS PROCESSES

BACKGROUND OF THE INVENTION

1. Field of the Invention

The present invention relates to a circuit generating a stable reference voltage with respect to temperature.

The invention relates, particularly but not exclusively, to a circuit generating a stable reference voltage with respect to temperature for CMOS process, the detailed description that follows covering this field of application for convenience of explanation only.

2. Description of the Related Art

As is well known, a requirement of most integrated electronic circuits is that at least one reference voltage be generated internally of the semiconductor chip in which they have been integrated.

An example of reference voltages internally generated a chip are VCM reference voltages having levels intermediate between the supply voltage values and being intended for use by several circuit sections integrated in the chip.

In particular, these internally generated reference voltages should be stable with respect to temperature and be unaffected by possible variations in the supply voltages, such as variations caused by rippling on the supply lines.

To provide a voltage reference that be unaffected by ripple, an internal reference voltage is normally used which is already provided in the chip structure.

In a typical P-substrate CMOS process, this internal reference voltage would be the base-emitter voltage Vbe of a parasitic PNP bipolar transistor created in the integrated circuit during the process.

This voltage actually exhibits a degree of dependence on temperature that can be eliminated, at least as concerns its first order component, by adding a compensating voltage to it, the latter voltage being quite easily obtained across a resistor through which an appropriate current flows.

More particularly, since the base-emitter voltage Vbe has a negative temperature coefficient, the compensating voltage is adjusted to have a positive temperature coefficient.

A simple known type of circuit adapted to generate such a reference voltage, compensated for temperature variations, is that shown generally and schematically at 1 in FIG. 1.

In particular, the generator circuit 1 comprises a bipolar transistor T1, specifically of PNP type, which is connected between a first voltage reference, e.g., a supply voltage Vcc, and a second voltage reference, e.g., a ground reference GND. In the instance of the integrated circuit that contains the voltage generator being formed with CMOS technology, a parasitic transistor may be utilized as transistor T1.

The bipolar transistor T1 has a first conduction terminal, which may be the collector terminal, connected to ground GND; a second conduction terminal, which may be the emitter terminal, connected to an internal circuit node X1; and a control terminal, i.e., the base terminal, connected to the first conduction terminal and ground.

This internal circuit node X1 is connected to the supply voltage reference Vcc through a series of a resistive element R1 and a generator G1 generating a current I1. The reference voltage Vref sought is picked off an output terminal OUT1 of the generator circuit 1, between the resistive element R1 and the generator G1.

To compensate for the thermal dependence of the base-emitter voltage Vbe of the bipolar transistor T1, the generator G1 supplies a current I1 having a positive coefficient of dependence on temperature.

As the skilled persons in the art know well, such a current value may be obtained by making use of a pair of parasitic bipolar transistors, biased to different current densities, from which a base-emitter voltage difference ΔVbe is derived for application to a resistive element of resistance R, so as to obtain a current:

$$I1=\Delta Vbe/R.$$

The current I1 thus obtained has a positive coefficient of dependence on temperature, and the reference voltage Vref at the output terminal OUT1 is, therefore, compensated for temperature.

It should be noted that in most cases, a current having these characteristics would be already provided in analog integrated circuits of the CMOS type, where it is used for biasing operational amplifiers, for example.

However, in such circuits, the reference voltage Vref, also known as the band-gap voltage, has in practice to approach the band-gap voltage of the silicon layer in which the whole circuitry is formed, in order to achieve good compensation of the temperature coefficients. This voltage is a physical constant that depends on the type of semiconductor employed, it being approximately 1.2 V for silicon.

Thus, the generator circuit 1 of FIG. 1 cannot provide reference voltages Vref that arestable with respect to temperature but displaced from the value of the band-gap voltage (1.2 V) for silicon. It is sometimes necessary, however, to have temperature-stable reference voltages generated which lie far from this value.

A prior approach to meeting this requirement is shown schematically in FIG. 2.

In particular, FIG. 2 shows a circuit 2 generating a stable voltage with respect to temperature, which circuit comprises essentially an operational amplifier OA2 having a first non-inverting (+) input terminal connected to a band-gap circuit BG2 adapted to supply the operational amplifier OA2 with a stable reference voltage with respect to temperature, Vref of about 1.2 V, same as in the prior approach just described.

The operational amplifier OA2 is in a buffer configuration having a first resistive element R21 connected between an output terminal and an inverting (−) input terminal of the amplifier OA2, and a second resistive element R22 connected between the inverting (−) input terminal and a voltage reference, e.g. a ground reference GND.

The generator circuit 2 uses the operational amplifier OA2 to convert the resulting stable voltage Vref=1.2 V provided by the band-gap circuit BG2 into another voltage KVref, where K is the gain of the buffer comprising the operational amplifier OA2.

In this way, any stable voltage value other than the band-gap value (equal approximately to 1.2 V) of the silicon layer can be derived from the temperature-stable voltage Vref.

To achieve values of the coefficient K greater than 1, the operational amplifier OA2 must be used in the non-inverting configuration.

While on several counts advantageous, there are drawbacks to this approach, among which:

an operational amplifier OA2 must be added to the chip own circuitry, resulting in more chip area and power being used up; and large resistors R21 and R22 must be used in order to limit power consumption by the generator circuit 2, resulting in further expenditure of chip area.

A further prior approach is based on the observation that many analog integrated circuits, especially those provided with converters, include differential circuits adapted to provide two voltage values whose difference ΔV is stable with respect to temperature. A circuit that provides a temperature-stable voltage that is a different value from the silicon layer band-gap value, based on the voltage difference ΔV, is shown generally and schematically at 3 in FIG. 3.

This circuit 3 comprises essentially an operational amplifier OA3, having an inverting (−) input terminal connected to a first input terminal IN31 of the circuit 3 through a first resistive element R31, and having a non-inverting (+) input terminal connected to a second input terminal IN32 of the circuit 3.

In particular, a voltage difference ΔV is established between the input terminals IN31 and IN32, which is stable with respect to temperature.

The operational amplifier OA3 also has an output terminal connected to the respective control terminals of first and second MOS transistors M31 and M32.

The first transistor M31 is connected between the inverting (−) input terminal of the operational amplifier OA3 and a ground reference GND, while the second transistor M32 is connected between a current-mirror circuit CM and ground GND.

This current-mirror circuit CM is also connected to an output terminal OUT3 of the circuit 3, and connected to ground GND through a third resistive element R33.

A voltage value Vout3 is obtained at the output terminal OUT3 of the circuit 3 which may have any selected value and is stable with respect to temperature, based on a voltage difference ΔV that is also stable with respect to temperature. This is achieved by matching the resistive elements.

The operation of this prior circuit 3 will now be described. The temperature-stabilized voltage difference ΔV is converted into a current I3=ΔV/R31 that flows through the first transistor M31. The feedback loop from the first transistor M1 to the inverting (−) input terminal of the operational amplifier OA3 pulls the output terminal of the operational amplifier OA3 to a voltage level adequate to force the first transistor M31 to invite a current equal to ΔV/R31.

This current I3 is suitably mirrored by the current-mirror circuit CM onto the second resistive element R32, and generates an output voltage Vout at the output terminal OUT3 of the circuit 3, which output voltage will be Vout=nΔV(R32/R31), where n is a proportional value to the mirroring ratio of the current-mirror circuit CM, comprising the aspect ratios of the transistors M31 and M32.

While achieving its objective, not even this approach is destitute of shortcomings.

In particular, the circuit 3 still employs an operational amplifier OA3, involving added use of integration area and power consumption.

Furthermore, the output impedance of the circuit 3 equals the resistance of the second resistive element R32. This resistance cannot be too low, in order to avoid a large waste of the current drain of circuit 3 to obtain the voltage Vout sought.

For this reason, an additional buffer circuit often has to be introduced after the structure of FIG. 3.

Thus, the circuit 3 is a seldom-used solution.

BRIEF SUMMARY OF THE INVENTION

An embodiment of the invention is directed to a circuit generating a reference voltage that is stable with respect to temperature and has structural and functional features appropriate to overcome the drawbacks that beset the circuits according to the prior art.

The reference voltage generating circuit has a feedback resistive element connected to a bipolar transistor used for generating a desired reference voltage, the feedback resistive element being operative to supply the bipolar transistor with a suitable current value effectively self-compensating for the dependence on temperature of the transistor base-emitter voltage.

The reference voltage generating circuit is connected between first and second voltage references, and comprises at least one current generating circuit adapted to inject a reference current into a resistive element that is connected between a base terminal of a bipolar transistor and an additional voltage reference, said bipolar transistor being connected between said first and second voltage references and connected to an output terminal of said generator circuit, whereat said stable reference voltage with respect to temperature is present, and further comprising at least another resistive element, feedback connected between said output terminal of said generator circuit and said base terminal of said bipolar transistor to enable injecting additional current, having reverse dependence on temperature from said reference current, into said resistive element.

The features and advantages of the circuit generating a stable reference voltage with respect to temperature, according to embodiments of the invention, will be apparent from the following detailed description of an embodiment thereof, given by way of non-limitative example with reference to the accompanying drawings.

DETAILED DESCRIPTION OF THE INVENTION

Figure 2:
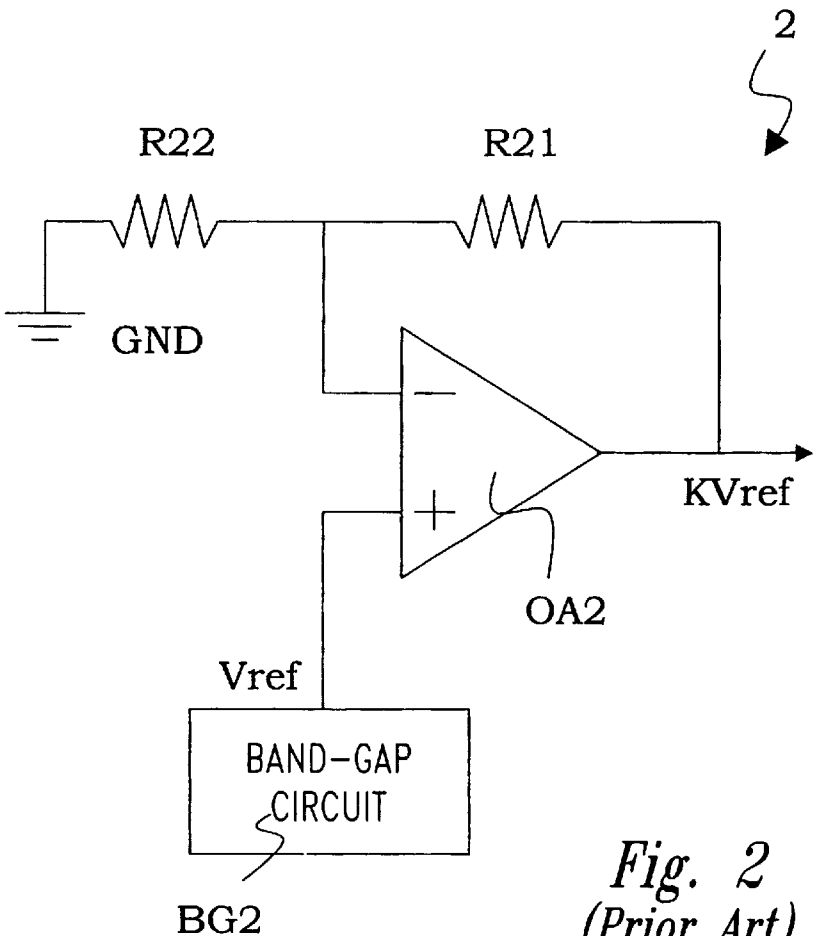
Fig. 2 (Prior Art)
FIG. 2 shows schematically a first variant of the generator circuit of FIG. 1.
Figure 1:
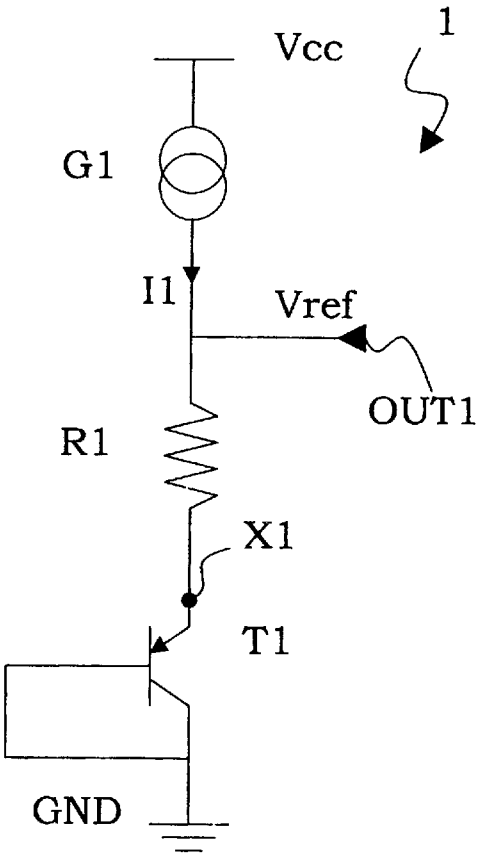
Fig. 1 (Prior Art)
FIG. 1 shows schematically a reference voltage generating circuit according to the prior art.
Figure 3:
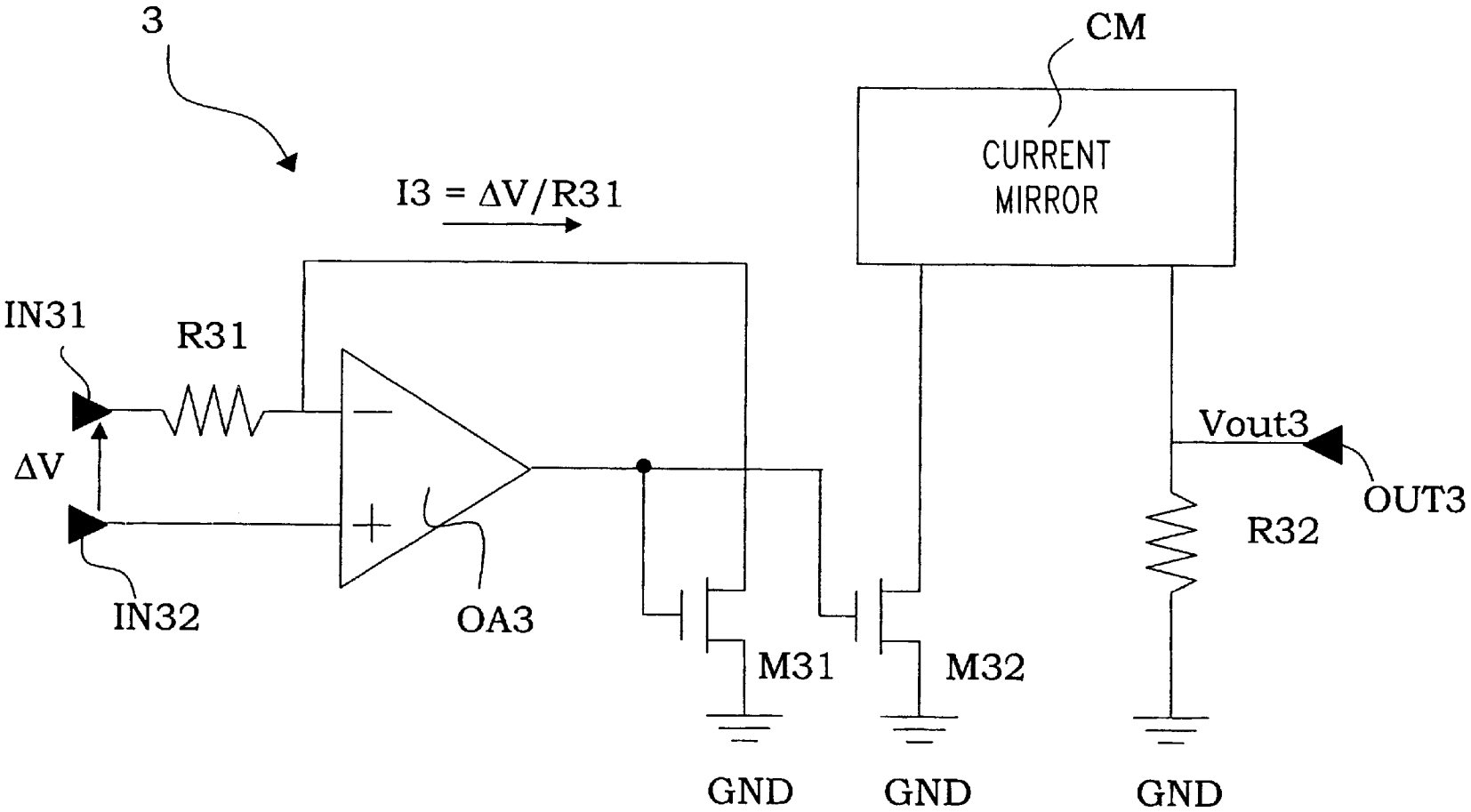
Fig. 3 (Prior Art)
FIG. 3 shows schematically a second variant of the generator circuit of FIG. 1.
Figure 4:
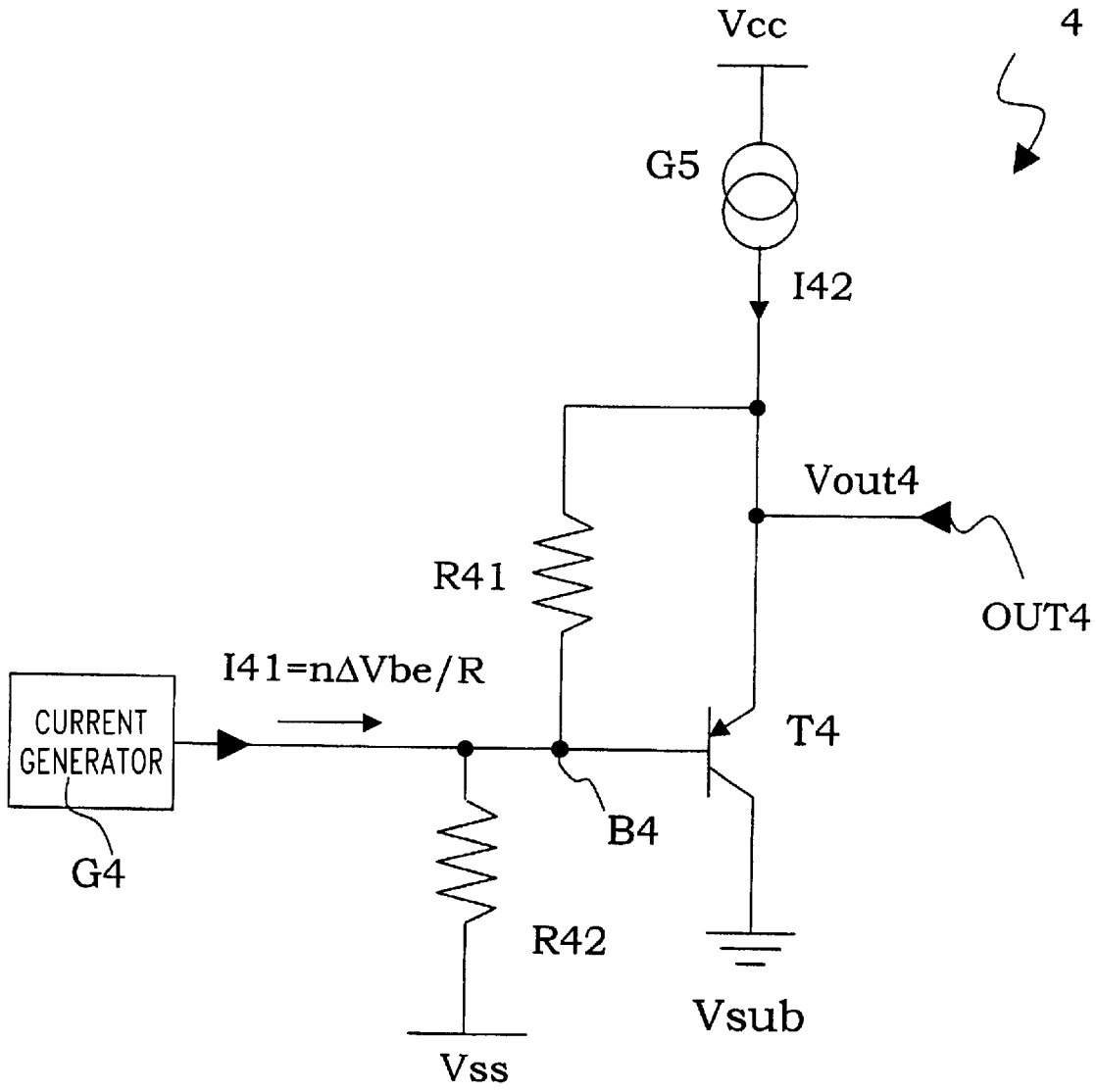
FIG. 4 shows schematically a reference voltage generating circuit according to an embodiment of the invention.

With reference to the drawings, in particular to FIG. 4, a circuit generating a reference voltage that is stable with respect to temperature, according to an embodiment of the invention, is shown generally at 4 in schematic form.

The generator circuit 4 comprises a current generating circuit G4 adapted to supply a reference current I41 to a resistive element R42 that is connected between a base terminal of a bipolar transistor T4 and a voltage reference, specifically a ground Vss.

The bipolar transistor T4 is connected to an output terminal OUT4 of the generator circuit 4, and an output voltage signal Vout4, having any value and being stable with respect to temperature, is presented on this terminal.

Figure 5:
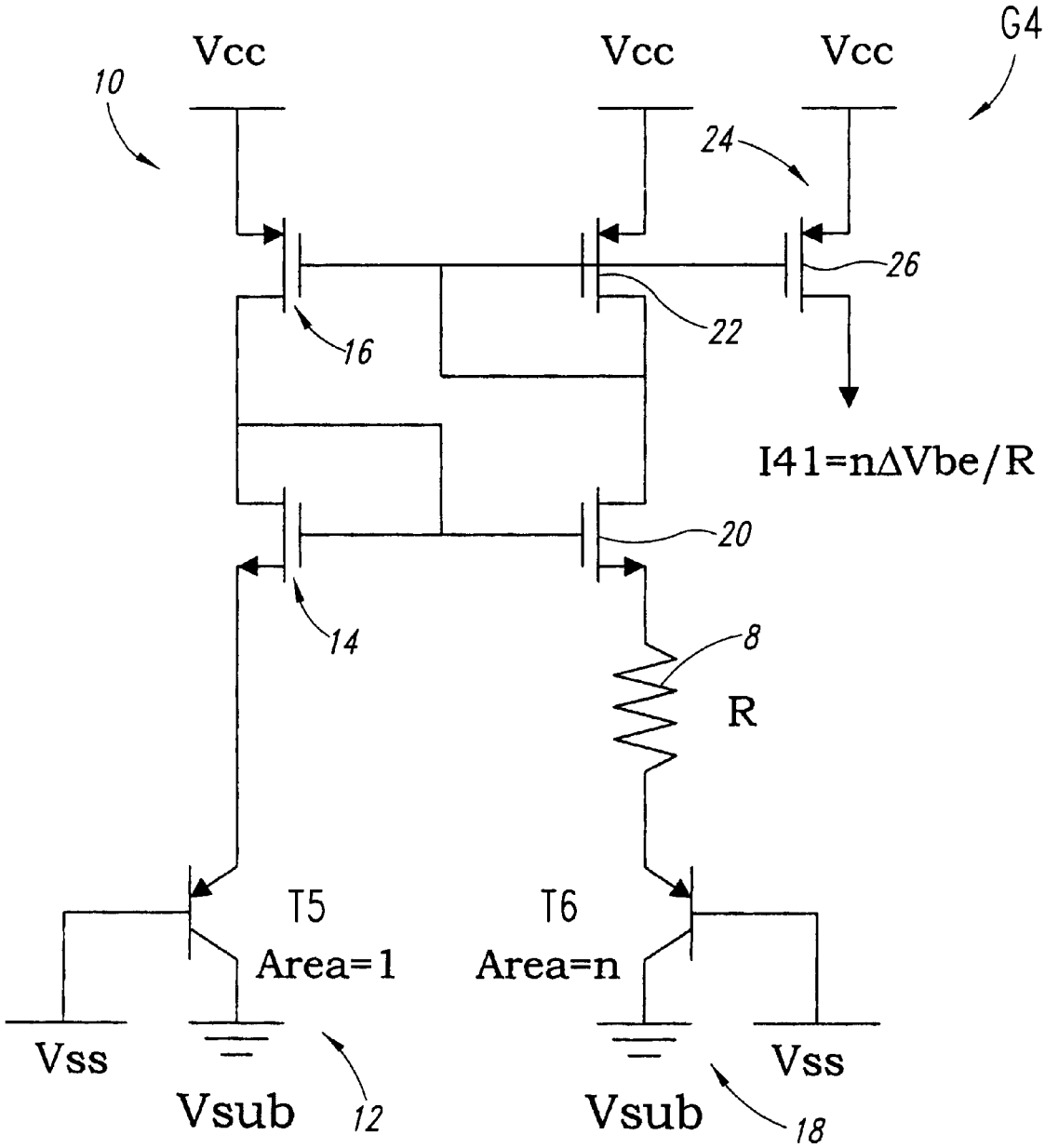
Fig. 5 (Prior Art)
FIG. 5 shows a current generator employed in the circuit of FIG. 4.

The reference current I41 is obtained, e.g., same as in the aforementioned prior art, by using a pair of parasitic bipolar transistors T5, T6, biased to different current densities, from which a base-emitter voltage difference ΔVbe is derived for application to a resistive element 8, having a resistance R, connected to the emitter of the transistor T6 as shown in FIG. 5. This voltage difference is then mirrored by a suitable current-mirror circuit 10, as provided in a conventional structure of the current generating circuit G4 shown in FIG. 5.

A first leg 12 of the current mirror 10 includes the transistor T5, having its collector connected to a substrate voltage Vsub, its base connected to ground Vss, and its emitter connected by first and second mirror transistors 14, 16 to the supply voltage Vcc. A second leg 18 of the current mirror 10 includes the transistor T6, having its collector connected to the substrate voltage Vsub, its base connected to ground Vss, and its emitter connected by the resistor 8, and third and fourth mirror transistors 20, 22 to the supply voltage Vcc. The gates of the first and third mirror transistors 14, 20 are connected together and to the drain of the first mirror transistor 14 while the gates of the second and fourth mirror transistors 16, 22 are connected together and to the drain of the fourth transistor 22 to provide the current mirror relationship. The current mirror 10 also includes a third leg 24 that includes a fifth mirror transistor 26 having its source connected to the supply voltage Vcc, its gate connected to the gates of the second and fourth mirror transistors 16, 22, and its drain acting as an output terminal at which the reference current I41 is produced. Therefore, the reference current:

$$I41=n\Delta Vbe/R,$$

i.e., a current value having a positive coefficient of dependence on temperature and a proportionality factor n accounting for the mirroring ratio and the aspect ratios of MOS transistors contained in the generator circuit, is obtained.

The bipolar transistor T4 is connected between a first voltage reference, which may be the supply voltage Vcc, and a second voltage reference, which may be a substrate voltage Vsub.

As said before in connection with the prior art, a parasitic transistor is used for the bipolar transistor T4 in CMOS technology circuits.

The bipolar transistor T4 also has:

- a first conduction terminal, specifically an emitter terminal, connected to the output terminal OUT4 of the generator circuit 4, and connected to the supply voltage reference Vcc through a generator G5 providing a bias current I42;
- a second conduction terminal, specifically a collector terminal, which is connected to the substrate voltage reference Vsub directly; and
- a control terminal, specifically a base terminal B4, connected to the current generating circuit BG4.

It should be noted that the generator G5 provides a bias current I42 which is proportional to ΔVbe/R by a factor n also accounting any mirroring factors.

Advantageously according to an embodiment of the invention, the generator circuit 4 comprises an additional resistive element R41, which is feedback connected between the output terminal OUT4 and the base terminal B4 of the bipolar transistor T4.

In particular, according to an embodiment of the invention, the additional resistive element R41 enables the injection, into the base terminal B4 of the bipolar transistor T4, of additional current exhibiting the same dependence on temperature as the base-emitter voltage Vbe4 of transistor T4, which voltage is related to the output voltage Vout4 and the base terminal voltage Vb4 of transistor T4 as follows:

$$Vbe4=Vout4-Vb4.$$

Advantageously according to an embodiment of the invention, the resistive element R42 will also bias the base terminal B4 to a suitable value, specifically a value equal to the product of the resistance of the resistive element R42 by the sum of the reference current I41 plus a current, equal to Vbe4/R41, from the resistor R41.

It should be noted that this generator circuit 4 provides an output voltage Vout4 such that:

$$Vout4=G(Vbe4+k\Delta Vbe)$$

where G is a gain factor.

Unlike the prior art, where in practice a band-gap voltage $V_{BG}$ is only amplified, the generator circuit 4 according to an embodiment of the invention makes use of the resistive element R41 to enable the injection of additional current into the resistive element R42 connected to the base terminal B4 of the bipolar transistor T4, this additional current having the same dependence on temperature as the base-emitter voltage Vbe of transistor T4. Also, the reference current I41 from the generator G4 flows through the resistive element R42 which exhibits reverse dependence on temperature from that of the additional current. In this way, a compensation with respect to temperature is achieved for the output voltage Vout4 without using operational amplifiers that require added integration space and use up power.

In particular, calling α and β the coefficients of dependence on temperature of the components Vbe and ΔVbe of the band-gap voltage $V_{BG}$, for the band-gap voltage $V_{BG}$ to be stable with respect to temperature, the proportionality factor k should be:

$$k=-\alpha/\beta.$$

This ratio equals 10 at typical values of the components Vbe and ΔVbe of the band-gap voltage $V_{BG}$.

In particular, if two bipolar transistors with a current density ratio of 1:10 are used for generating the band-gap voltage $V_{BG}$, the following values would be obtained:

$$Vbe\sim-0.6\text{ V and }\Delta Vbe\sim-0.06\text{ V}$$

i.e., a value for the band-gap voltage $V_{BG}$ of about 1.2 V.

To obtain temperature-stable reference voltages of a value other than the above, acting on the single degree of freedom provided by factor k is not enough.

Advantageously according to an embodiment of the invention, the generator circuit 4 has another degree of freedom provided by the additional resistive element R41 connected between the emitter and base terminals of the bipolar transistor T4.

In the generator circuit 4 according to an embodiment of the invention, an amplification factor G is thus added to factor k such that independence of temperature can be achieved, as explained in connection with the prior art, even at values of the output voltage Vout4 other than 1.2 V.

Advantageously according to an embodiment of the invention, by introducing the additional resistive element R41, a current is injected into the resistive element R42 which is proportional to the base-emitter voltage difference Vbe of transistor T4, and accordingly, has the same dependence on temperature as the voltage difference Vbe from which the band-gap voltage $V_{BG}$ is derived.

The generator circuit 4 according to an embodiment of the invention obeys the following simultaneous equations:

$$Vout4 = Vbe\left(1 + \frac{R41}{R42}\right) + n\frac{\Delta VbeR42}{R} \quad (1)$$

$$0 = \left(1 + \frac{R41}{R42}\right)\cdot\alpha + n\left(\frac{\beta\cdot R42}{R}\right)$$

where:

- α and β are coefficients of dependence on temperature of first order of the voltages Vbe and ΔVbe, components of the band-gap voltage $V_{BG}$;
- n is a mirroring factor of the input current I41 relative to a reference value equal ΔVbe/R;
- R is the resistance of the resistor employed to obtain the input current I4, that is, the factor of inverse proportionality of that current to the base-emitter voltage difference ΔVbe;
- R42 and R41 are the resistances of the resistive element and the additional resistive element of the generator circuit 4; and
- Vout4 is the value of the output voltage from the generator circuit 4.

Advantageously according to an embodiment of the invention, by selecting appropriate resistances for the resistive elements R41 and R42, values of the output voltage Vout4 which are stable with respect to temperature and higher than the band-gap voltage of 1.2 V, a limiting value in conventional band-gap circuits, can be obtained.

It should be noted that the output impedance of the generator circuit 4 according to an embodiment of the invention does not vary much from the low output impedance of a parasitic bipolar transistor. Also, by selecting appropriate values for the parameter n and the resistive elements R41, R42, reasonable values for the resistive element R42 can be obtained (on the order of a few tens kiloOhms).

In this way, integration area can be saved, and the current that flows through the additional resistive element R41 can be limited.

To summarize, a major advantage of this generator circuit 4 over the prior art is the very compact size of the circuit; unlike prior circuits, this circuit requiring no operational amplifiers, so that it has reduced integration area requirements and can keep current usage low.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A generator circuit generating a stable reference voltage with respect to temperature, the circuit being connected between first and second voltage references and comprising:

- a first bipolar transistor connected between first and second voltage references and to an output terminal of the generator circuit whereat the stable reference voltage with respect to temperature is;
- a first resistive element connected between a base terminal of the first bipolar transistor and a third voltage reference;
- a current generating circuit structured to inject a reference current into the first resistive element; and
- a second resistive element, feedback connected between the output terminal of the generator circuit and the base terminal of the first bipolar transistor to enable injecting additional current into the first resistive element, the additional current having reverse dependence on temperature with respect to the reference current.

2. The generator circuit of claim 1, wherein the reference current is directly proportional, by a first proportionality factor, to a base-emitter voltage difference of second and third bipolar transistors operated at different current densities, and inversely proportional, by a second proportionality factor, to the base-emitter voltage difference, the base-emitter voltage difference being dependent on the temperature by a coefficient of dependence.

3. The generator circuit of claim 2, wherein the base-emitter voltage of the first bipolar transistor is dependent on the temperature by another coefficient of dependence.

4. The generator circuit of claim 3, wherein the reference voltage is the sum of the base-emitter voltage plus a voltage across said first resistive element, the reference voltage being stable with respect to temperature and having any value.

5. The generator circuit of claim 4, wherein it yields to the following simultaneous equations:

$$Vout4 = Vbe\left(1 + \frac{R41}{R42}\right) + n\frac{\Delta VbeR42}{R}$$

$$0 = \left(1 + \frac{R41}{R42}\right)\cdot\alpha + n\left(\frac{\beta\cdot R42}{R}\right)z$$

where:

- α and β are the coefficients of dependence;
- n is the first proportionality factor;
- R is the second proportionality factor;
- R42 and R41 are the resistance values of the first resistive element and second resistive element, respectively; and
- Vout4 is the reference voltage value generated by the generator circuit.

6. The generator circuit of claim 1, further comprising a generator, connected between the first voltage reference and the output terminal of the generator circuit to generate a bias current.

7. The generator circuit of claim 1, being formed with CMOS technology, and wherein the bipolar transistor is a parasitic transistor.

8. A generator circuit of a reference voltage which is stable with respect to temperature, the circuit comprising:

- a first bipolar transistor connected between a first and a second voltage references and connected to an output terminal of the generator circuit;
- a first current generator connected to a control terminal of the bipolar transistor and providing a reference current;
- a resistive element connected between the control terminal of the bipolar transistor and an additional voltage reference having reverse dependence on temperature with respect to the reference current; and
- a second resistive element, feedback connected between the output terminal of the generator circuit and the control terminal of the bipolar transistor, the output terminal of the generator circuit thus providing a stable reference voltage with respect to temperature.

9. The generator circuit of claim 8, wherein the first current generator comprises second and third bipolar transistors, said second and third bipolar transistors being operated at different current densities and having a base-emitter voltage difference dependent on the temperature by a coefficient of dependence, the first current generator providing the reference current which is directly proportional, by a first proportionality factor, to the base-emitter voltage difference and inversely proportional, by a second proportionality factor, to the base-emitter voltage difference.

10. The generator circuit of claim 9, wherein the first bipolar transistor has a base-emitter voltage dependent on the temperature by another coefficient of dependence.

11. The generator circuit of claim 10, wherein the reference voltage is obtained by summing the base-emitter voltage of the first bipolar transistor and a further voltage across the first resistive element.

12. The generator circuit of claim 11, wherein it yields to the following simultaneous equations:

$$Vout4 = Vbe\left(1 + \frac{R41}{R42}\right) + n\frac{\Delta VbeR42}{R}$$

$$0 = \left(1 + \frac{R41}{R42}\right) \cdot \alpha + n\left(\frac{\beta \cdot R42}{R}\right)$$

where:

$\alpha$ and $\beta$ are the coefficients of dependence;

n is the first proportionality factor;

R is the second proportionality factor;

R42 and R41 are the resistance values of the first and second resistive elements; and Vout4 is the reference voltage value provided at the output terminal of the generator circuit.

13. The generator circuit of claim 8, further comprising a second current generator connected between the first voltage reference and the output terminal of the generator circuit and providing a bias current.

14. The generator circuit of claim 8, being formed with CMOS technology, and wherein the first bipolar transistor is a parasitic transistor.

15. Method for generating a reference voltage which is stable with respect to temperature, the method comprising:

providing a bipolar transistor connected between a first and a second voltage references;

injecting a reference current into a resistive element connected between a control terminal of the bipolar transistor and an additional voltage reference having reverse dependence on temperature with respect to the reference current;

providing a second resistive element, feedback connected between a first conduction terminal and the control terminal of the bipolar transistor; and generating a reference voltage stable with respect to temperature and having any value by adding a base-emitter voltage of the bipolar transistor and a voltage across said resistive element.

16. The method of claim 15, wherein the reference current is directly proportional, by a first proportionality factor, and inversely proportional, by a second proportionality factor, to a base-emitter voltage difference of two bipolar transistors operated at different current densities, the base-emitter voltage difference being dependent on the temperature by a coefficient of dependence.

17. The method of claim 16, wherein the base-emitter voltage of the bipolar transistor is dependent on the temperature by another coefficient of dependence.

* * * * *